US005518769A

United States Patent [19]

Sagiyama et al.

[11] Patent Number: 5,518,769

[45] Date of Patent: May 21, 1996

[54] PROCESS FOR MANUFACTURING GALVANNEALED STEEL SHEET HAVING EXCELLENT ANTI-POWDERING PROPERTY

[75] Inventors: Masaru Sagiyama; Masaki Abe; Junichi Inagaki; Akira Hiraya; Masaya Morita, all of Tokyo, Japan

[73] Assignee: NKK Corporation, Tokyo, Japan

[21] Appl. No.: 332,446

[22] Filed: Oct. 31, 1994

Related U.S. Application Data

[63] Continuation of Ser. No. 920,595, filed as PCT/JP91/01801, Dec. 27, 1991, abandoned.

[30] Foreign Application Priority Data

Dec. 28, 1990 [JP] Japan ..... 2-415498

[51] Int. Cl.[6] ..... B05D 3/02

[52] U.S. Cl. ..... 427/319; 427/320; 427/329; 427/398.1; 427/405; 427/433; 427/436; 427/434.2

[58] Field of Search ..... 427/319, 320, 427/329, 378.1, 405, 433, 436, 434.2

[56] References Cited

U.S. PATENT DOCUMENTS 5,049,453 9/1991 Suemitsu et al. ..... 427/433
5,105,454 4/1992 Saito et al. ..... 427/433
5,141,781 8/1992 Suzuki et al. ..... 427/433

FOREIGN PATENT DOCUMENTS 62-256959 11/1987 Japan ..... L23L 2/28
63-157847 6/1988 Japan ..... L23L 2/06
64-17843 1/1989 Japan ..... L23C 2/28

*Primary Examiner*—Benjamin Utech
*Attorney, Agent, or Firm*—Nields & Lemack

[57] ABSTRACT

It is an object to provide a process for manufacturing galvannealed steel sheets exhibiting excellent anti-powdering property when press formed, and uniform frictional properties in a coil. A steel strip is galvanized in a bath having a low aluminum content after entering it at a high temperature as defined in relation to the aluminum content of the both, so that the formation of a ζ phase may be promoted. Then, the strip is heated for alloying in a high-frequency induction heating furnace so as to have a temperature not exceeding 495° C. when leaving the furnace to yield a plated steel strip having a coating containing a uniformly distributed ζ phase. After such heat treatment and cooling, the strip can be plated with an iron or iron-alloy top coating having an iron content of at least 50% and a coating weight of at least 1 g/m$^2$ to achieve an improved press formability.

2 Claims, 2 Drawing Sheets

PROCESS FOR MANUFACTURING GALVANNEALED STEEL SHEET HAVING EXCELLENT ANTI-POWDERING PROPERTY

This application is a continuation of application Ser. No. 07/920,595 filed as PCT/JP91/01801, Dec. 27, 1991 now abandoned.

TECHNICAL FIELD

This invention relates to a process for manufacturing galvannealed steel sheets which are used for making automobile bodies and parts, etc., and particularly which exhibit excellent anti-powdering property when press formed, and stable frictional properties in a coil. BACKGROUND ART:

There has recently been a growing demand for galvannealed steel sheets for use as rust-proof steel sheet materials for automobiles, since they exhibit high corrosion resistance and weldability when painted. The latest tendency has been toward sheets having a greater coating weight to ensure high corrosion resistance.

These galvanized steel sheets are required to have high press-formability and exhibit excellent anti-powdering property when press formed. These requirements have lately been becoming more stringent, and the increasing coating weight has been creating a big problem in the maintenance of, above all, excellent anti-powdering property.

There is known a process which comprises heating galvanized steel sheets rapidly to cause the alloying of a part of coating, and batch annealing them to improve their anti-powdering property, as disclosed in, for example, Japanese Patent Publication No. Sho 59-14541. This process is effective in achieving an improved anti-powdering property, but has the drawback of being expensive.

Japanese Laid-Open Patent Application No. Sho 64-17843 discloses a process for achieving an improved anti-powdering property in line. According to its disclosure, a steel strip is galvanized in a bath containing 0.003 to 0.13% of aluminum, and is subjected to alloying treatment at a low temperature (in the range of 520° C. to 470° C. within which the temperature is lower with a reduction in the aluminum content of the bath), so that a ζ phase which is effective for anti-powdering property may be allowed to remain in the surface layer of coating.

The alloying treatment at a low temperature, however, calls for a long time, and necessitates, therefore, a reduction of line speed or an enlargement of equipment, leading to a lowering of productivity or an increase of equipment cost.

Moreover, a direct gas-fired alloying furnace which is usually employed is likely to cause a variation in temperature of a strip along its width and length, and thereby makes difficult the strict control of the coating structure as hereinabove stated, resulting in the formation of a coating having excessively alloyed portions or containing a residual η phase (pure zinc). The resulting galvanized steel sheet lacks uniformity in the amount of its ζ phase and therefore in its anti-powdering property.

The amount of the ζ phase has so close a bearing on the frictional properties that the lack of uniformity in its amount brings about the lack of uniformity in press formability.

Although a top coating can be formed on the alloyed coating to lower its frictional coefficient and improve its press formability, no stable press formability can be obtained if the alloyed coating lacks uniformity in the amount of the ζ phase.

DISCLOSURE OF THE INVENTION:

In view of the problems of the prior art as hereinabove pointed out, we, the inventors of this invention, have studied an alloying reaction on a galvanized steel sheet, and found the following:

(1) The ζ phase is formed by a reaction at or below 495° C., and is not formed at any temperature exceeding it; and (2) Therefore, it is possible to form a coating containing a residual ζ phase if the principal reaction (the reaction which causes a molten zinc phase to disappear) is caused to take place at a temperature not exceeding 495° C., followed by cooling. FIGS. 1 and 2 show by way of example phase changes resulting from isothermal alloying reactions on galvanized steel sheets at 450° C. and 500° C., respectively. While the alloying at 450° C. results in the formation of a ζ phase, the alloying at 500° C. hardly forms any ζ phase.

The alloying at such a low temperature, however, calls for a long time, and therefore, a reduction of line speed or an enlargement of equipment. Moreover, the use of a usual direct-fired alloying furnace is likely to cause uneven firing resulting in the formation of an unevenly alloyed layer. It is necessary to raise the furnace temperature to avoid uneven firing, but the alloying treatment at a high temperature results in a product not containing any residual ζ0 phase, but having a low anti-powdering property.

Under these circumstances, we have tried to explore a process which can always reliably be employed to achieve both anti-powdering property and press formability which are satisfactorily excellent and have discovered the following:

(1) It is possible to obtain by a short time of alloying treatment a coating containing a ζ phase distributed uniformly along the width and length of a strip if the alloying reaction (formation of a ζ phase) in a zinc bath is promoted, and if the subsequent alloying treatment is carried out by employing a high-frequency induction heating furnace;

(2) The resulting alloyed coating exhibits excellent anti-powdering property owing to the alloying reaction taking place uniformly not only macroscopically as hereinabove stated, but also microscopically;

(3) It is possible to achieve a strict coating control if the conditions of the bath and the temperature of the strip leaving the high-frequency induction heating furnace are appropriately selected;

(4) More specifically, it is possible to promote the alloying reaction (formation of a ζ phase) in the bath if the bath has a low aluminum content, and if the strip entering the bath has a relatively high temperature as defined in relation to the aluminum content of the bath, and it is possible to obtain the coating as described at (1) and (2) above if the alloying treatment of the galvanized strip in the high-frequency induction heating furnace is so performed that the strip leaving the furnace may have a temperature not exceeding 495° C.; and (5) The alloyed coating exhibits good and uniform press formability if it is covered with a small amount of a top coating.

This invention is based on the foregoing discovery, and according to a first aspect of this invention, there is provided a process for manufacturing galvannealed steel sheets by galvanizing a steel strip in a zinc bath. containing aluminum, the balance of its composition being zinc and unavoidable impurities, adjusting its coating weight, and subjecting the strip to alloying treatment in a heating furnace so that its coating may have an iron content of 8 to 12%, characterized in that the bath has an aluminum content of at least 0.05%, but less than 0.13%, and a temperature not exceeding 470° C., the strip having, when entering the bath, a temperature not exceeding 495° C., the aluminum content of the bath and the temperature of the strip entering the bath satisfying the following relationship:

$$437.5\times[Al\%]+448\geqq T\geqq 437.5\times[Al\%]+428$$

where

[Al%]: the aluminum content (%) of the bath;

T : the temperature (°C.) of the strip entering the bath, so that an alloying reaction forming a ζ phase in the bath may be promoted, and that the furnace is a high-frequency induction furnace in which the strip is heated so as to have a temperature not exceeding 495° C. when leaving the furnace, the strip being held at that temperature for a predetermined length of time, and cooled.

According to a second aspect of this invention, the cooled strip is plated with an iron or iron-alloy top coating having an iron content of at least 50% and a coating weight of at least 1 $g/m^2$.

Figure 1:
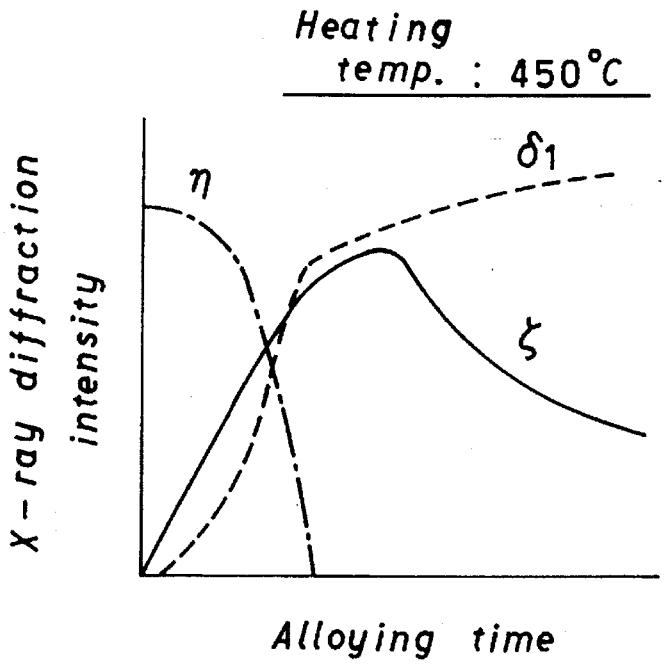
FIG. 1 shows by way of example the phase changes occurring in galvanized steel sheets as a result of the isothermal alloying reaction at 450° C.
Figure 2:
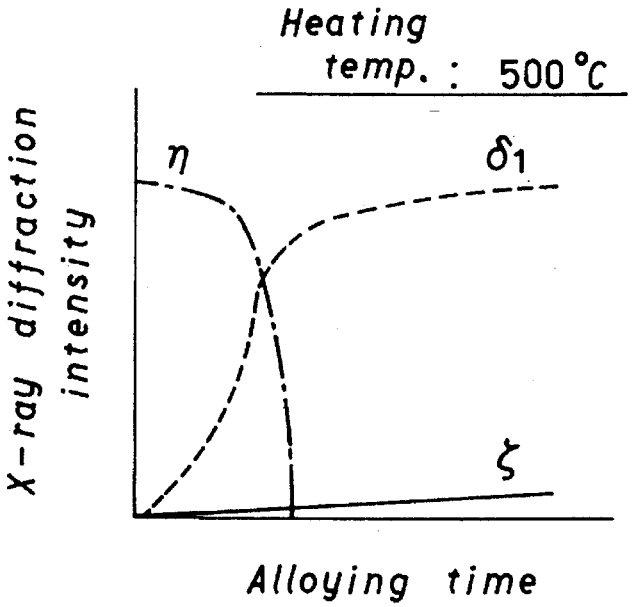
FIG. 2 shows by way of example the phase changes occurring in galvanized steel sheets as a result of the constant-temperature alloying reaction at 500° C.

DETAILED DESCRIPTION OF THE INVENTION:

The alloying treatment of plated steel sheets by high-frequency induction heating is known, as described in, for example, Japanese Patent Publication No. Sho 60-8289 and Japanese Laid-Open Patent Application No. Hei 2-37425. The arts disclosed therein are, however, nothing but the use of high-frequency induction heating as a means for rapid heating.

On the other hand, this invention is based on the discovery of the fact that, if the alloying reaction forming a ζ phase is promoted in the bath, and if the coating is subjected to alloying treatment by high-frequency induction heating under specific conditions, it is possible to produce a galvanized steel strip having an improved anti-powdering property due to the macroscopically very uniform formation of a ζ phase and the microscopic uniformity of the coating structure.

It is presumably for the reasons as will hereunder be set forth that the process of this invention can manufacture galvanized steel sheets having outstanding properties as hereinabove stated.

In the first place, the use of high-frequency induction heating for the alloying treatment enables the direct heating of the strip and particularly of its surface contacting the coating which, as opposed to gas heating, allows the reaction of iron and zinc to occur rapidly and uniformly on the surface of any strip portion and thereby form a product carrying a uniformly distributed ζ phase and exhibiting uniform anti-powdering property.

In the second place, the direct heating of the strip as hereinabove stated apparently brings about an even microscopically uniform alloying reaction. The conventional alloying treatment by gas heating is likely to lack heating uniformity and result in an alloying reaction which microscopically lacks uniformity, since heat is applied from the outside of the coating. The grain boundary is particularly high in reactivity and is, therefore, likely to undergo the so-called outburst reaction forming an outburst structure which causes the growth of a Γ phase lowering the anti-powdering property of the coating. On the other hand, high-frequency induction heating, which enables the direct heating of the strip, enables a substantially uniform alloying reaction and facilitates the diffusion of oxides on the strip and an alloying inhibitor ($Fe_2Al_5$) formed in the bath, thereby enabling the formation of an even microscopically uniform alloy layer.

In the third place, the majority of the ζ phase is formed by the alloying reaction in the bath and the subsequent alloying treatment by high-frequency induction heating is hardly affected by the alloying inhibitor $Fe_2Al_5$, this apparently enabling microscopic uniformity and thereby an improved anti-powdering property. According to this invention, the ζ phase formed in the bath is the product of diffusion of iron in $Fe_2Al_5$ formed in the bath in the beginning. In other words, the diffusion of iron occurs in the bath. Therefore, there is only a small amount of $Fe_2Al_5$ as the alloying inhibitor during the heating for alloying, and moreover, the direct heating of the strip by high-frequency induction heating facilitates the diffusion of the remaining alloying inhibitor. According to the conventional process in which the formation of a ζ phase in the bath is not promoted, the diffusion of iron is caused only by heating in the furnace and takes place rapidly therein, and therefore, the alloying treatment not only by gas heating, but also even by high-frequency induction heating, is likely to have a delayed alloying of a thick $Fe_2Al_5$ portion, resulting in an alloy layer lacking microscopic uniformity and having low anti-powdering property.

The macroscopically and microscopically uniform alloying as hereinabove described apparently contributes also to achieving stable and uniform press formability.

The high-frequency induction heating of the plated strip does not cause any oxidation of the coating surface, but enables the appropriate application of a top coating onto the alloyed coating surface, and thereby stable press formability by a smaller top coating weight than is required on a coating alloyed by gas heating.

Description will now be made of the essential features of this invention and the reasons for the limitations employed to define it.

According to this invention, the aluminum content of a plating bath, the temperature of a steel strip entering the bath and the bath temperature are so specified as to promote an alloying reaction forming a ζ phase in the bath.

While aluminum is added to restrict the reaction of iron and zinc in the bath, it is an important aspect of this invention to promote the alloying reaction (formation of a ζ phase) in the bath and it is, therefore, necessary to use a bath having a relatively low aluminum content. If its aluminum content is too low, however, a localized alloying reaction called an outburst reaction takes place in the bath, and results in the formation of a coating containing a thick Γ phase and having low anti-powdering property. Therefore, the aluminum content of the bath need be at least 0.05%. No satisfactory reaction forming a ζ phase takes place in any bath having an aluminum content of 0.13% or above. Therefore, the aluminum content of the bath need be less than 0.13%.

The control of the temperature of the strip entering the bath is important to ensure the formation of a ζ phase in the bath. The upper and lower limits which are allowable for the temperature of the strip entering the bath are defined in relation to the aluminum content of the bath, as will hereinafter be set forth, and its upper limit is not allowed to exceed 495° C. since no ζ phase is formed at any temperature exceeding it.

The temperature of the strip entering the bath is required to satisfy the following relationship to the aluminum content of the bath:

$$437.5\times[Al\%]+448 \geqq T \geqq 437.5\times[Al\%]+428$$

where

[Al%]: the aluminum content (%) of the bath;

T : the temperature (°C.) of the strip entering the bath.

If the temperature of the strip entering the bath exceeds the upper limit as defined above, it disables the satisfactory formation of a ζ phase, and is likely to cause an outburst resulting in the formation of a Γ phase, even if it may not exceed 495° C. If it is lower than the lower limit, there does not occur any satisfactory alloying to promote the formation of a ζ phase in the bath as intended by this invention. The higher the strip temperature within the range as defined above, the larger amount of a ζ phase is formed in the bath, and therefore, the larger amount of the ζ phase the coating contains.

If the temperature of the strip entering the bath exceeds 495° C., it not only disables the formation of a ζ phase, but also presents other problems including an increase of heat input to the pot which calls for the use of additional equipment such as means for lowering the bath temperature, and an increase of dross formed in the bath with a resultant increase of surface defects.

Although a high bath temperature promotes the alloying reaction (formation of the ζ phase) in the bath, too high a bath temperature brings about problems such as the erosion of structural members immersed in the bath and the resulting formation of dross. Therefore, the bath temperature is limited to a level not exceeding 470° C.

The strip which has been galvanized is heated for alloying in a high-frequency induction heating furnace. The heating by a high-frequency induction heating furnace is a salient feature of this invention other than the bath conditions as hereinabove set forth, since no alloyed coating as intended by this invention can be obtained by the conventional gas heating as hereinbefore stated. The alloying treatment is carried out by heating the strip so that the strip leaving the furnace may have a temperature not exceeding 495° C., holding it for a predetermined length of time, and cooling it. Heating at a temperature not exceeding 495° C. is necessary to form a ζ phase, as hereinabove stated. The strip temperature is controlled at the discharge end of the high-frequency induction heating furnace, since in that area, the strip reaches the. maximum temperature in an alloying heat cycle. The control of the strip temperature at the discharge end of the furnace enables an alloying reaction at that temperature, since the rate of growth of the alloy layer reaches the maximum in that area.

This invention is intended for manufacturing galvannealed steel sheets having a coating containing 8 to 12% of iron. A coating containing more than 12% of iron is hard, and inferior in anti-powdering property. If alloying is continued beyond the discharge end of the high-frequency induction heating furnace, a diffusion reaction in a solid results in the formation of a coating having a higher iron content. Rapid cooling is, therefore, necessary when an appropriate iron content has been attained. A coating having an iron content of less than 8% is also undesirable, since an η phase (pure zinc) remains on the coating surface and causes flaking when the strip is press formed.

Although it has hitherto been believed that the iron content of a coating has a decisive bearing on its structure, the appropriately selected bath conditions and the alloying treatment by high-frequency induction heating, as proposed by this invention, enable the formation of a specific coating structure as intended by this invention, irrespective of its iron content.

The alloyed coating obtained as hereinabove described is composed of a uniform ζ phase on its surface, a $\delta_1$ phase underlying it, and a very thin Γ phase underlying it.

Figure 3:
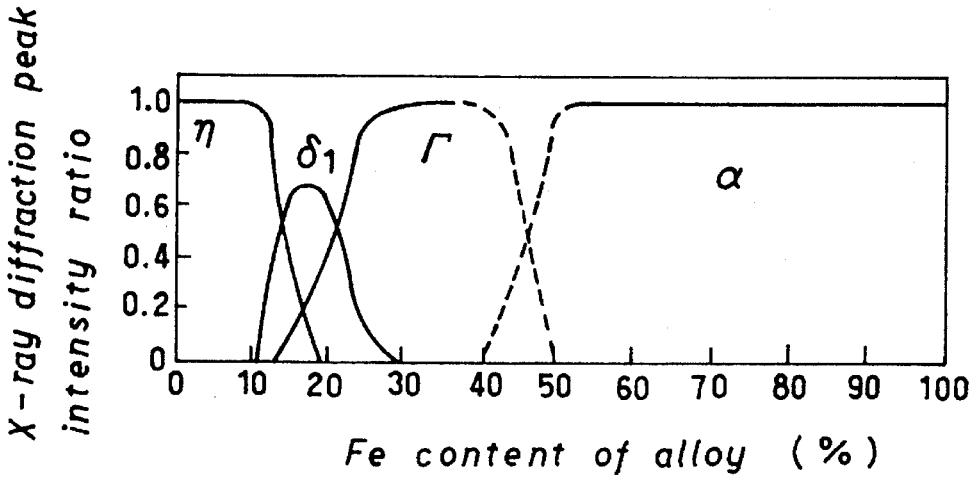
FIG. 3 shows the phase composition of an electro-deposited Zn-Fe alloy.

An iron or iron-alloy top coating having an iron content of at least 50% and a coating weight of at least 1 g/m$^2$ can be applied onto the alloyed coating to lower its coefficient of friction and improve its press formability. The top coating preferably consists solely of an α phase to ensure a lower coefficient of friction. An iron or iron-alloy coating having an iron content of at least about 50% consists solely of an α phase, as shown in FIG. 3.

Figure 4:
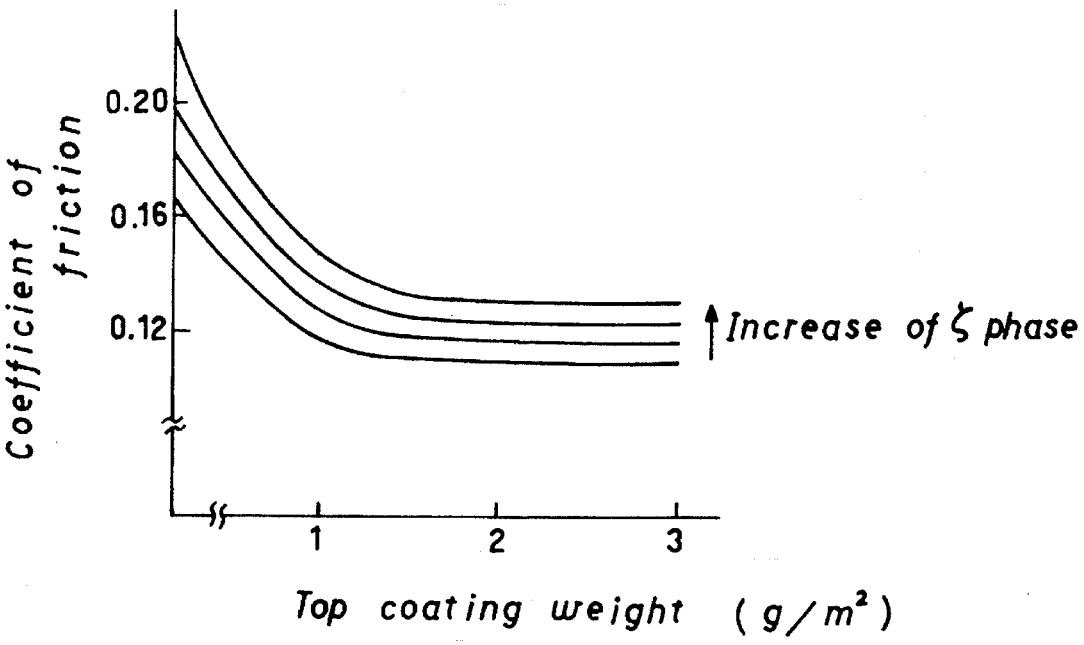
FIG. 4 shows a coefficient of friction in relation to the top coating weight.

No top coating weight that is less than 1 g/m$^2$ is sufficient for achieving a satisfactorily lower coefficient of friction. FIG. 4 shows the coefficient of friction in relation to the top coating weight. It is obvious therefrom that a coating weight of at least 1 g/m$^2$ makes it possible to attain a frictional coefficient not exceeding 0.13. Although the top coating weight has no particular upper limit, it is preferable from an economical standpoint to set an upper limit of 3 g/m$^2$. The high-frequency induction heating of the plated strip, as proposed by this invention, does not cause any oxidation of the coating surface, but enables the appropriate application of the top coating onto the alloyed coating surface, and thereby a reduction in top coating weight, as compared with what is required on a coating alloyed by gas heating.

It is also obvious from FIG. 4 that the amount of an ζ phase formed in an alloyed coating has a smaller effect on the coefficient of friction of a strip having a top coating than that of a strip having no top coating (having a top coating weight of 0 g/m$^2$), and that the top coating can effectively achieve a lower coefficient of friction on even a coating containing a large amount of ζ phase.

EXAMPLES:

Examples of this invention are shown in TABLES 1 to 8.

These examples were carried out by employing as starting materials cold rolled sheets of Al-killed steel (containing 0.03% C and 0.02% sol. Al) and Ti-containing IF steel (containing 0.0025% C, 0.04% sol. Al and 0.07% Ti), and galvanizing and heat treating them under the conditions shown in TABLES 1, 2, 5 and 6. In the examples shown in TABLES 5 and 6, top coating was applied after heat treatment. The top coating was applied by an electroplating apparatus installed at the discharge end of the line. The heat treatment was carried out by gas or high-frequency induction heating. The anti-powdering property and press formability of the galvannealed steel sheets which were obtained are shown in TABLES 3, 4, 7 and 8.

The temperature of the sheet entering the zinc bath was its surface temperature as measured by a radiation pyrometer immediately before it entered the bath. The temperature of the sheet leaving the heating furnace was its surface temperature as measured by a radiation pyrometer at the discharge end of the furnace.

The aluminum content of the bath is the effective aluminum concentration as defined by the following equation:

[Effective Al concentration]=[Total Al concentration of bath]−[Iron concentration of bath] +0.03

The percentage of iron in the coating depends on the bath conditions, and the heating and cooling conditions. The cooling conditions vary the degree of alloying (% of Fe in the coating) and thereby affect its properties, though they hardly have any effect on the macroscopic or microscopic uniformity of the coating structure defining one of the salient features of this invention. Therefore, the examples were carried out by controlling the capacity of a cooling blower and the amount of mist to regulate the percentage of iron in the coating.

The following is a description of the methods which were employed for testing and evaluating the products for properties:

Amount of ζ phase in coatings on products:

The peak intensity, $I\zeta_{[421]}$, of the ζ phase at d=1.900 and the peak intensity, $I\delta_{1_{[429]}}$, of the $\delta_1$ phase at d=1.990 were determined by the X-ray diffraction of the coating, and their ratio was cabulated in accordance with the following equation as representing the amount of the ζ phase in the coating. $I_{BG}$ represents the background, and if Z/D is not in excess of 20, there is substantially no ζ phase.

$$Z/D=(I\zeta_{[421]}-I_{BG})/(I\zeta_{1[249]}-I_{BG})\times 100$$

Anti-powdering property:

After each specimen had been coated with 1 g/m$^2$of a rust-preventing oil (Nox Rust 530F of Parker Industries, Inc.), a draw bead test was conducted by employing a bead radius R of 0.5 mm, a holding load P of 500 kg and an indentation depth h of 4 mm, and after tape had been peeled off, the amount of powdering was calculated from a difference in weight of the specimen from its initial weight. Each of the values appearing in the tables is the average of a plurality of values as measured (5×5=25).

Maximum deviation of anti-powdering property along strip width:

The anti-powdering property of each strip was measured at five points along its length and at five points along its width (both edges, midway between each edge and the center, and the center) under stabilized operating conditions, and the difference between the maximum and minimum values was taken as the maximum deviation.

Coefficient of friction:

After each specimen had been coated with 1 g/m$^2$of rust-preventing oil (Nox Rust 530F of Parker Industries, Inc.), an indenter made of tool steel SKDll was held against the specimen under a load of 400 kg and it was drawn at a speed of 1 m/min. The ratio of the drawing and holding loads was taken as the frictional coefficient. Each of the values appearing in the tables is the average of a plurality of values as measured (5×5=25).

Maximum deviation of coefficient of friction along strip width:

The coefficient of friction was measured at the same points as those at which the anti-powdering property had been measured, and the difference between the maximum and minimum values was taken as the maximum deviation.

Referring to TABLES 1 to 4, the products of Comparative Examples 1 and 2 did not contain any ζ phase, despite their alloying treatment by high-frequency induction heating, since the temperatures of the strips entering the bath had been too high for the formation of any ζ phase in the bath. Thus, they were bad in anti-powdering property.

In Comparative Examples 3, 4 and 9, the temperatures of the strips entering the bath were too low to cause any alloying reaction forming a ζ phase in the bath. Although the products of these comparative examples had the ζ phase formed by heat treatment at temperatures not exceeding 495° C., they had low and greatly varying anti-powdering property due to the microscopic non-uniformity of the alloying reaction, as no ζ phase had been formed in the bath.

The coating on the product of Comparative Example 5 did not contain any ζ phase due to too high a temperature attained by high-frequency induction heating, though a ζ phase had been formed in the plating bath. It was, therefore, bad in anti-powdering property.

In Comparative Examples 6 to 8 and 10, gas heating was employed after a ζ phase had been formed in the bath. The product of Comparative Example 6 had very bad and greatly varying anti-powdering property, since the temperature attained by gas heating had been too high to maintain the ζ phase in the coating, and since uneven firing had formed a localized thick Γ phase. The products of Comparative Examples 7 and 8 had bad anti-powdering property and press formability varying greatly along the strip width because of the localized thick Γ phase formed by uneven firing, and of the locally remaining η phase, though the strip temperatures had been sufficiently low to maintain a ζ phase in the coating. Their inferiority in the microscopic uniformity of the alloyed layer was another reason for their bad anti-powdering property. The product of Comparative Example 10 also had greatly varying properties as a result of uneven firing, and its bad properties were for the reasons as hereinabove set forth.

In Prior Art Examples 1 to 4, no ζ phase was formed in the bath. The product of Prior Art Example 3 had bad and greatly varying anti-powdering property due to the microscopic non-uniformity of the alloying reaction, as was the case with Comparative Example 2, though high-frequency induction heating had been employed.

TABLES 5 to 8 show the examples in which top coating was applied after heat treatment. The coatings on the products of Comparative Examples 11 and 12 did not contain any ζ phase at all, though high-frequency induction heating had been employed for alloying, since the temperatures of the strips entering the bath had been too high to allow the formation of a ζ phase in the bath. Thus, they were bad in anti-powdering property.

In Comparative Examples 13, 14 and 21, the temperatures of the strips entering the bath were too low to cause any alloying reaction forming a ζ phase in the bath. They had bad and greatly varying anti-powdering property due to the microscopic non-uniformity of the alloying reaction as no ζ phase had been formed in the bath, though the coatings contained a ζ phase as a result of heating at temperatures not exceeding 495° C.

Comparative Examples 15 and 16 were carried out to enable comparison with respect to the top coating weight.

In Comparative Example 17, in which a ζ phase had been formed in the plating bath, the temperature attained by high-frequency induction heating was too high to maintain the ζ phase in the coating. Thus, the product was bad in anti-powdering property.

In Comparative Examples 18 to 20 and 22, gas heating was employed after a ζ phase had been formed in the bath.

The product of Comparative Example 18 had very bad and greatly varying anti-powdering property, since the temperature attained by gas heating had been too high to maintain the ζ phase in the coating, and since uneven firing had formed a localized thick Γ phase. The products of Comparative Examples 19 and 20 had bad anti-powdering property and press formability varying greatly along the strip width because of the localized thick Γ phase formed by uneven firing, and of a locally remaining η phase, though the temperatures attained by gas heating had been sufficiently low to maintain the ζ phase in the coating. Their inferiority in the microscopic uniformity of the alloyed layer was another reason for their bad anti-powdering property. The product of Comparative Example 22 also had greatly varying properties as a result of uneven firing, and its bad properties were for the reasons as hereinabove set forth.

In Prior Art Examples 5 to 8, no ζ phase was formed in the bath. The product of Prior Art Example 7 had bad and greatly varying anti-powdering property due to the microscopic non-uniformity of the alloying reaction, as was the case with Comparative Example 6, though high-frequency induction heating had been employed.

TABLE 1

| No. | *1 Steel type | Plating conditions: Temp. of strip entering the bath (°C.) | Al content of the bath (wt %) | Line speed (mpm) | Heating | Temp. of strip leaving the heating furnace (°C.) | Coating weight (g/m²) | Fe content of the coating (wt %) | *2 Amount of ζ phase in product (Z/D) |
|---|---|---|---|---|---|---|---|---|---|
| Comparative Example 1 | A | 508 | 0.127 | 100 | Inducting heating | 485 | 58.5 | 10.3 | 19.6 (none) |
| Comparative Example 2 | A | 500 | 0.05 | 120 | Inducting heating | 480 | 60.2 | 11.0 | 18.2 (none) |
| Invention's Example 1 | A | 490 | 0.122 | 90 | Inducting heating | 485 | 57.3 | 10.2 | 62.6 |
| Invention's Example 2 | A | 481 | 0.110 | 90 | Inducting heating | 470 | 58.6 | 10.0 | 55.4 |
| Invention's Example 3 | A | 472 | 0.075 | 90 | Inducting heating | 480 | 60.0 | 9.9 | 49.7 |
| Comparative Example 3 | A | 472 | 0.120 | 90 | Inducting heating | 492 | 62.2 | 10.3 | 26.9 |
| Comparative Example 4 | A | 448 | 0.050 | 70 | Inducting heating | 490 | 58.9 | 10.1 | 40.1 |
| Invention's Example 4 | A | 490 | 0.120 | 90 | Inducting heating | 475 | 55.1 | 10.0 | 55.8 |
| Invention's Example 5 | A | 487 | 0.120 | 90 | Inducting heating | 475 | 57.1 | 9.9 | 52.9 |
| Comparative Example 5 | A | 490 | 0.102 | 90 | Inducting heating | 520 | 61.0 | 10.5 | 16.8 (none) |

*1 Steel type A: Al-killed steel; Steel type B: Ti-containing IF steel
*2 No ζ phase if Z/D is not more than 20

TABLE 2

| No. | *1 Steel type | Plating conditions: Temp. of strip entering the bath (°C.) | Al content of the bath (wt %) | Line speed (mpm) | Heating | Temp. of strip leaving the heating furnace (°C.) | Coating weight (g/m²) | Fe content of the coating (wt %) | *2 Amount of ζ phase in product (Z/D) |
|---|---|---|---|---|---|---|---|---|---|
| Invention's Example 6 | A | 490 | 0.102 | 90 | Inducting heating | 495 | 60.5 | 10.4 | 42.7 |
| Invention's Example 7 | A | 490 | 0.101 | 90 | Inducting heating | 480 | 60.8 | 10.2 | 62.1 |
| Comparative Example 6 | A | 485 | 0.100 | 90 | Gas heating | 515 | 60.1 | 11.0 | 18.9 (none) |
| Comparative Example 7 | A | 485 | 0.100 | 90 | Gas heating | 490 | 61.4 | 10.2 | 28.0 |
| Comparative Example 8 | A | 485 | 0.100 | 90 | Gas heating | 468 | 60.5 | 9.1 | 54.2 |
| Comparative Example 9 | B | 475 | 0.120 | 90 | Inducting heating | 485 | 56.2 | 10.2 | 48.3 |
| Invention's Example 8 | B | 481 | 0.120 | 90 | Inducting heating | 484 | 55.9 | 10.1 | 56.8 |
| Invention's Example 9 | B | 490 | 0.120 | 90 | Inducting heating | 485 | 55.6 | 10.5 | 65.9 |
| Comparative Example 10 | B | 486 | 0.120 | 90 | Gas heating | 485 | 57.8 | 10.8 | 50.9 |
| Former Example 1 | A | 460 | 0.128 | 90 | Gas heating | 480 | 58.9 | 9.5 | 35.4 |
| Fermar Example 2 | A | 462 | 0.130 | 90 | Gas heating | 490 | 57.8 | 9.2 | 32.8 |
| Fermar Example 3 | A | 461 | 0.130 | 90 | Inducting heating | 470 | 59.0 | 9.8 | 44.0 |
| Fermar Example 4 | A | 461 | 0.100 | 90 | Gas heating | 480 | 58.0 | 9.5 | 46.0 |

*1 Steel type A: Al-killed steel; Steel type B: Ti-containing IF steel
*2 No ζ phase if Z/D is not more than 20

TABLE 3

| No. | *1 Anti-powdering property (g/m²) | *2 Maximum deviation along strip width (g/m²) | Frictional coefficient | *3 Maximum deviation along strip width | Remarks |
|---|---|---|---|---|---|
| Comparative Example 1 | 8.0 | 0.40 | 0.145 | 0.006 | Because of the high temperature of strip |

TABLE 3-continued

| No. | *1 Anti-powdering property ($g/m^2$) | *2 Maximum deviation along strip width ($g/m^2$) | Frictional coefficient | *3 Maximum deviation along strip width | Remarks |
|---|---|---|---|---|---|
| | | | | | entering, ζ phase cannot be formed and the anti-powdering property is low. |
| Comparative Example 2 | 10.2 | 0.55 | 0.142 | 0.005 | Because of the high temperature of strip entering, ζ phase cannot be formed and the anti-powdering property is low. |
| Invention's Example 1 | 3.5 | 0.20 | 0.175 | 0.003 | |
| Invention's Example 2 | 3.1 | 0.19 | 0.162 | 0.002 | |
| Invention's Example 3 | 2.8 | 0.21 | 0.158 | 0.002 | |
| Comparative Example 3 | 7.7 | 0.42 | 0.158 | 0.004 | Because of no reaction in the bath, has the microscopic non-uniformity and low anti-powdering property. |
| Comparative Example 4 | 6.5 | 0.38 | 0.160 | 0.005 | Because of no reaction in the bath, has the microscopic non-uniformity and low anti-powdering property. |
| Invention's Example 4 | 3.2 | 0.20 | 0.162 | 0.003 | |
| Invention's Example 5 | 3.4 | 0.20 | 0.161 | 0.002 | |
| Comparative Example 5 | 7.9 | 0.58 | 0.149 | 0.003 | Because the strip leaving temperature of high frequency induction heating furnace is high, anti-powdering property is low. |

*1 Good if it is not more than 4 $g/m^2$ (at a coating weight of 60 $g/m^2$)
*2 Good if it is not more than 0.3 $g/m^2$
*3 Good if it is not more than 0.003

TABLE 4

| No. | *1 Anti-powdering property ($g/m^2$) | *2 Maximum deviation along strip width ($g/m^2$) | Frictional coefficient | *3 Maximum deviation along strip width | Remarks |
|---|---|---|---|---|---|
| Invention's Example 6 | 3.6 | 0.20 | 0.156 | 0.002 | |
| Invention's Example 7 | 3.7 | 0.21 | 0.165 | 0.003 | |
| Comparative Example 6 | 9.8 | 1.25 | 0.147 | 0.006 | Uneven firing formed portions having thick rphases. |
| Comparative Example 7 | 6.1 | 0.88 | 0.155 | 0.005 | Uneven firing formed portions having thick rphases. |
| Comparative Example 8 | 4.8 | 0.70 | 0.170 | 0.012 | Uneven firing formed portions having residual η phases. |
| Comparative Example 9 | 4.8 | 0.45 | 0.166 | 0.004 | Because of no reaction in the bath, the microscopic non-uniformity and has low anti-powdering property |
| Invention's Example 8 | 4.0 | 0.20 | 0.162 | 0.002 | |
| Invention's Example 9 | 3.9 | 0.22 | 0.158 | 0.002 | |
| Comparative Example 10 | 4.9 | 0.40 | 0.164 | 0.004 | Because of uneven firing, size vary widely. |
| Former Example 1 | 6.8 | 0.50 | 0.159 | 0.007 | |
| Former Example 2 | 7.2 | 0.59 | 0.155 | 0.005 | |
| Former Example 3 | 5.5 | 0.40 | 0.162 | 0.003 | |
| Former Example 4 | 6.0 | 0.55 | 0.158 | 0.005 | |

*1 Good if it is not more than 4 $g/m^2$ (at a coating weight of 60 $g/m^{2)}$
*2 Good if it is not more than 0.3 $g/m^2$
*3 Good if it is not more than 0.003

TABLE 5

| | | Undercoat plating conditions | | | | | | | | |
|---|---|---|---|---|---|---|---|---|---|---|
| No. | *1 Steel type | Temp. of strip entering bath (°C.) | Al content of bath (wt %) | Line speed (mpm) | Heating | Temp. of strip leaving the heating furnace (°C.) | Coating weight ($g/m^2$) | Fe content of the coating (wt %) | Top coating weight ($g/m^2$) | *6 Amount of ζ phase in product (Z/D) |
| Comparative Example 11 | A | 508 | 0.127 | 100 | Inducting heating | 485 | 58.5 | 10.3 | 2.3 | 19.6 |
| Comparative Example 12 | A | 500 | 0.05 | 120 | Inducting heating | 480 | 60.2 | 11.0 | 1.8 | 18.2 |
| Invention's Example 10 | A | 490 | 0.122 | 90 | Inducting heating | 485 | 57.3 | 10.2 | 1.8 | 62.6 |

TABLE 5-continued

| No. | *1 Steel type | Undercoat plating conditions: Temp. of strip entering bath (°C.) | Al content of bath (wt %) | Line speed (mpm) | Heating | Temp. of strip leaving the heating furnace (°C.) | Coating weight (g/m²) | Fe content of the coating (wt %) | Top coating weight (g/m²) | *6 Amount of ζ phase in product (Z/D) |
|---|---|---|---|---|---|---|---|---|---|---|
| Invention's Example 11 | A | 481 | 0.110 | 90 | Inducting heating | 470 | 58.6 | 10.0 | 2.2 | 55.4 |
| Invention's Example 12 | A | 472 | 0.075 | 90 | Inducting heating | 480 | 60.0 | 9.9 | 2.0 | 49.7 |
| Comparative Example 13 | A | 472 | 0.120 | 90 | Inducting heating | 492 | 62.2 | 10.3 | 1.9 | 26.9 |
| Comparative Example 14 | A | 448 | 0.050 | 70 | Inducting heating | 490 | 58.9 | 10.1 | 2.1 | 40.1 |
| Comparative Example 15 | A | 480 | 0.120 | 90 | Inducting heating | 475 | 55.8 | 10.5 | 0.5 | 54.2 |
| Comparative Example 16 | A | 485 | 0.120 | 90 | Inducting heating | 475 | 56.7 | 10.3 | 0.8 | 57.5 |
| Invention's Example 13 | A | 490 | 0.120 | 90 | Inducting heating | 475 | 55.1 | 10.0 | 2.2 | 55.8 |
| Invention's Example 14 | A | 487 | 0.120 | 90 | Inducting heating | 475 | 57.1 | 9.9 | 2.8 | 52.9 |
| Comparative Example 17 | A | 490 | 0.102 | 90 | Inducting heating | 520 | 61.0 | 10.5 | 2.2 | 16.8 |

*1 Steel type A: Al-killed steel; Steel type B: Ti-containing IF steel
*6 No ζ phase if Z/D is not more than 20

TABLE 6

| No. | *1 Steel type | Undercoat plating conditions: Temp. of strip entering bath (°C.) | Al content of bath (wt %) | Line speed (mpm) | Heating | Temp. of strip leaving the heating furnace (°C.) | Coating weight (g/m²) | Fe content of the coating (wt %) | Top coating weight (g/m²) | *6 Amount of ζ phase in product (Z/D) |
|---|---|---|---|---|---|---|---|---|---|---|
| Invention's Example 15 | A | 490 | 0.102 | 90 | Inducting heating | 495 | 60.5 | 10.4 | 2.3 | 42.7 |
| Invention's Example 16 | A | 490 | 0.101 | 90 | Inducting heating | 480 | 60.8 | 10.2 | 2.0 | 28.0 |
| Comparative Example 18 | A | 485 | 0.100 | 90 | Gas heating | 515 | 60.1 | 11.0 | 1.8 | 18.9 |
| Comparative Example 19 | A | 485 | 0.100 | 90 | Gas heating | 490 | 61.4 | 10.2 | 2.0 | 62.1 |
| Comparative Example 20 | A | 485 | 0.100 | 90 | Gas heating | 468 | 60.5 | 9.1 | 2.2 | 54.2 |
| Comparative Example 21 | B | 475 | 0.120 | 90 | Inducting heating | 485 | 56.2 | 10.2 | 2.5 | 48.3 |
| Invention's Example 17 | B | 481 | 0.120 | 90 | Inducting heating | 484 | 55.9 | 10.1 | 2.4 | 56.8 |
| Invention's Example 18 | B | 490 | 0.120 | 90 | Inducting heating | 485 | 55.6 | 10.5 | 2.7 | 65.9 |
| Comparative Example 22 | B | 486 | 0.120 | 90 | Gas heating | 485 | 57.8 | 10.8 | 2.2 | 50.9 |
| Former Example 5 | A | 460 | 0.128 | 90 | Gas heating | 480 | 58.9 | 9.5 | 2.5 | 35.4 |
| Former Example 6 | A | 462 | 0.130 | 90 | Gas heating | 490 | 57.8 | 9.2 | 2.8 | 32.8 |
| Former Example 7 | A | 461 | 0.130 | 90 | Inducting heating | 470 | 59.0 | 9.8 | 3.0 | 44.0 |
| Former Example 8 | A | 461 | 0.100 | 90 | Gas heating | 480 | 58.0 | 9.5 | 2.9 | 46.0 |

*1 Steel type A: Al-killed steel; Steel type B: Ti-containing IF steel
*6 No ζ phase if Z/D is not more than 20

TABLE 7

| No. | *2 Anti-powdering property (g/m²) | *3 Maximum deviation along strip width g(/m²) | *4 Frictional coefficient | *5 Maximum deviation along strip width | Remarks |
|---|---|---|---|---|---|
| Comparative Example 11 | 8.0 | 0.40 | 0.122 | 0.004 | Because of the high temperature of strip entering, ζ phase cannot be formed and |

TABLE 7-continued

| No. | *2 Anti-powdering property (g/m²) | *3 Maximum deviation along strip width g(/m²) | *4 Frictional coefficient | *5 Maximum deviation along strip width | Remarks |
|---|---|---|---|---|---|
| | | | | | the anti-powdering property is low. |
| Comparative Example 12 | 10.2 | 0.55 | 0.123 | 0.003 | Because of the high temperature of strip entering, ζ phase cannot be formed and the anti-powdering property is low. |
| Invention's Example 10 | 3.5 | 0.20 | 0.127 | 0.002 | |
| Invention's Example 11 | 3.1 | 0.19 | 0.128 | 0.003 | |
| Invention's Example 12 | 2.8 | 0.21 | 0.127 | 0.002 | |
| Comparative Example 13 | 7.7 | 0.42 | 0.131 | 0.004 | Because of no reaction in the bath, has the microscopic non-uniformity and low anti-powdering property. |
| Comparative Example 14 | 6.5 | 0.38 | 0.128 | 0.005 | Because of no reaction in the bath, has the microscopic non-uniformity and low anti-powdering property. |
| Comparative Example 15 | 3.0 | 0.33 | 0.145 | 0.006 | Because the top coating weight is small, coefficient of friction is high and size vary widely. |
| Comparative Example 16 | 3.2 | 0.22 | 0.138 | 0.005 | |
| Invention's Example 13 | 3.2 | 0.20 | 0.129 | 0.003 | |
| Invention's Example 14 | 3.4 | 0.20 | 0.126 | 0.002 | |
| Comparative Example 17 | 7.9 | 0.58 | 0.123 | 0.005 | Because the strip leaving temperature of high frequency induction heating furnace is high, anti-powdering property is low. |

*3 Good if it is not more than 0.3 g/m²
*4 Good if it is not more than 0.13
*5 Good if it is not more than 0.003

TABLE 8

| No. | *2 Anti-powdering property (g/m²) | *3 Maximum deviation along strip width (g/m²) | *4 Frictional coefficient | *5 Maximum deviation along strip width | Remarks |
|---|---|---|---|---|---|
| Invention's Example 15 | 3.6 | 0.20 | 0.127 | 0.002 | |
| Invention's Example 16 | 3.7 | 0.21 | 0.128 | 0.002 | |
| Comparative Example 18 | 9.8 | 1.25 | 0.133 | 0.008 | Uneven firing formed portions having thick phases. |
| Comparative Example 19 | 6.1 | 0.88 | 0.138 | 0.009 | Uneven firing formed portions having thick phases. |
| Comparative Example 20 | 4.8 | 0.70 | 0.145 | 0.012 | Uneven firing formed portion having residual η phases. |
| Comparative Example 21 | 4.8 | 0.45 | 0.129 | 0.002 | Because of no reaction in the bath, has the microscopic non-uniformity and low anti-powdering property. |
| Invention's Example 17 | 4.0 | 0.20 | 0.128 | 0.003 | |
| Invention's Example 18 | 3.9 | 0.22 | 0.126 | 0.003 | |
| Comparative Example 22 | 4.9 | 0.40 | 0.145 | 0.007 | Because of uneven firing, size vary widely. |
| Former Example 5 | 6.8 | 0.50 | 0.128 | 0.006 | |
| Former example 6 | 7.2 | 0.59 | 0.127 | 0.007 | |
| Former example 7 | 5.5 | 0.40 | 0.127 | 0.003 | |
| Former example 8 | 6.0 | 0.55 | 0.128 | 0.007 | |

*2 Good if it is not more than 4 g/m² (at a coating weight of 60 g/m²)
*3 Good if it is not more than 0.3 g/m²
*4 Good if it is not more than 0.13
*5 Good if it is not more than 0.003

We claim:

1. A process for manufacturing galvannealed steel sheets by plating a steel strip in a zinc plating bath containing aluminum, the balance of its composition being zinc and impurities, adjusting its coating weight, and subjecting said strip to alloying treatment in a heating furnace so that its coating has an iron content of 8 to 12%, characterized in that said bath has an aluminum content of at least 0.05%, but less than 0.13%, and a temperature not exceeding 470° C., said strip having a temperature not exceeding 495° C. when entering said bath, said aluminum content of said bath and said temperature of said strip satisfying the following relationship:

$$437.5\times Al\%+448 \geqq T \geqq 437.5\times Al\%+428$$

where

Al%: the percent aluminum content of said bath;

T: the temperature, in degrees Celsius, of said strip entering said bath, so that an alloying reaction forming a ζ phase in said bath is sufficiently promoted so that Z/D is in excess of 20, wherein:

$$Z/D=(I\zeta_{(421)}-I_{BG})/(I\delta_{1(249)}-I_{BG})\times 100$$

wherein $I\zeta_{(421)}$ is the peak intensity of the ζ phase at d=1.900; $I_{BG}$ is the background intensity; and $I\delta_{1(249)}$ is the peak intensity of the $\delta_1$ phase at d=1.990, and that said furnace is a high-frequency induction furnace in which said strip is heated so as to have a temperature not exceeding 495° C. when leaving said furnace, said strip being held at that temperature, and cooled, thereby to form a plated film having a surface layer consisting essentially of a ζ phase and a layer under said surface layer consisting essentially of $\delta_1$ phase.

2. A process for manufacturing galvannealed steel sheets by plating a steel strip in a zinc plating bath containing aluminum, the balance of its composition being zinc and impurities, adjusting its coating weight, and subjecting said strip to alloying treatment in a heating furnace so that its coating has an iron content of 8 to 12%, characterized in that said bath has an aluminum content of at least 0.05%, but less than 0.13%, and a temperature not exceeding 470° C., said strip having a temperature not exceeding 495° C. when entering said bath, said aluminum content of said bath and said temperature of said strip satisfying the following relationship:

$$437.5\times Al\%+448 \geqq T \geqq 437.5\times Al\% +428$$

where

Al%: the percent aluminum content of said bath;

T: the temperature, in degrees Celsius, of said strip entering said bath, so that an alloying reaction forming a ζ phase in said bath is sufficiently promoted so that Z/D is in excess of 20, wherein:

$$Z/D=(I\zeta_{(421)}-I_{BG})/(I\delta_{1(249)}-I_{BG})\times 100$$

wherein $I\zeta_{(421)}$ peak intensity of the ζ phase at d=1.900; $I_{BG}$ is the background intensity; and $I\delta_{1(249)}$ is the peak intensity of the $\delta_1$ phase at d=1.990, and that said furnace is a high-frequency induction furnace in which said strip is heated so as to have a temperature not exceeding 495° C. when leaving said furnace, said strip being held at that temperature, and cooled, thereby to form a plated film having a surface layer consisting essentially of a ζ phase and a layer under said surface layer consisting essentially of $\delta_1$ at phase, and that said strip is plated with an iron or iron-alloy top coating having an iron content of at least 50% and a coating weight of at least 1 $g/m^2$.

* * * * *